US006533118B1

(12) United States Patent
Nelson

(10) Patent No.: US 6,533,118 B1
(45) Date of Patent: Mar. 18, 2003

(54) CARD HOLDING DEVICE

(76) Inventor: Michael T. Nelson, 6805 Garden Hwy., Sacramento, CA (US) 95837

( * ) Notice: Subject to any disclaimer, the term of this patent is extended or adjusted under 35 U.S.C. 154(b) by 0 days.

(21) Appl. No.: 09/872,464

(22) Filed: May 31, 2001

(51) Int. Cl.[7] ..... B42F 17/00

(52) U.S. Cl. ..... 206/449; 206/37.1; 206/39; 211/50

(58) Field of Search ..... 40/642.02, 643, 40/653, 654.01; 206/37, 37.1, 39, 39.4–39.6, 449; 211/50

(56) References Cited

U.S. PATENT DOCUMENTS 648,603 A * 5/1900 Whitehead ..... 206/449
844,933 A * 2/1907 Gurley ..... 40/653
912,110 A * 2/1909 Gill ..... 206/39.5
963,760 A * 7/1910 Hackett ..... 206/39.5
1,452,278 A * 4/1923 Kind ..... 206/37
2,268,025 A * 12/1941 Erickson ..... 211/50
2,343,277 A * 3/1944 Clark ..... 206/449
3,471,006 A * 10/1969 Tempelhof ..... 206/449
4,424,906 A * 1/1984 Richmond ..... 211/50
4,492,307 A * 1/1985 Hargrave ..... 206/449
6,105,294 A * 8/2000 Goodfellow ..... 206/39.5

* cited by examiner

*Primary Examiner*—Jim Foster
(74) *Attorney, Agent, or Firm*—Theodore J. Bielen, Jr.

(57) ABSTRACT

A holding device for single or multiple cards utilizing a backing member having a first surface and an opposite second surface. A guard extends across and spaces from the first surface to form a slot. The guard includes a surface facing the first surface of the backing member. A ledge is spaced from the guard and extends from the backing member. The ledge also includes a surface which projects from the first surface a distance greater than the surface of the guard. A card is supported within the slot and contacts the surface of the guard, and the surface of the ledge.

7 Claims, 1 Drawing Sheet

CARD HOLDING DEVICE

BACKGROUND OF THE INVENTION

The present invention relates to a novel and useful holding device for single or multiple cards.

Key cards have become commonplace in modern society. That is to say, key cards have replaced metallic keys in many situations. The advantage of a key card is that the codes which are recognized by an electronic lock may be programmed and reprogrammed with very little effort. In addition, the production of new or replacement cards is quite expensive to achieve once the electronic lock system is installed within a building such as a hotel.

Unfortunately, key cards are easy to misplace and must be retrieved when a person leaves a room, such as a hotel room. The result of not toting a key card when leaving a room would be that the occupant is locked out and must obtain another card from the issuer of the cards, usually at a hotel desk. In addition to being inconvenient, the reissuance of a card normally entails changing of a code which cancels the use of other cards held by other persons, also denying them access to a room.

A card holding device which readily stores and permits the retrieval of the key card when leaving a room would be a notable advance in the security field.

BRIEF SUMMARY OF THE INVENTION

In accordance with the present invention a novel and useful holding device for single or multiple cards is herein provided.

The device of the present invention utilizes a backing member. The backing member includes a first surface and an opposite second surface. The backing member may be formed of any suitable material such as plastic, metal, wood, and the like. The backing member first surface may include an area which is greater than the area on one side of the card. In addition, the first surface of the backing member may be formed of a material which is resistant to rubbing and impact.

The device of the present invention also entails the use of a guard which extends across and is spaced from the first surface of the backing member. The guard also possesses a surface facing the first surface of the backing member. A slot is, thus, formed between the first surface of the backing member and the surface of the guard. Needless to say, the slot is sized in order to permit single or multiple cards to be placed therewithin.

The device of the present invention is also constructed with a ledge that is spaced from the guard and extends from the backing member. The ledge possesses a surface which projects from the first surface of the backing member a distance greater than the spacing of the surface of the guard from the first surface of the backing member.

Moreover, the distance from the surface of the ledge to a portion of the surface of the card extends above the center of gravity of a card when it is placed within the slot formed by the guard and backing member. Thus, when a card is supported in the slot against the backing member, it does not slip from the slot since the card will contact the surface of the ledge, the surface of the guard, and the surface of the backing member. Also, if a single card is tilted in an opposite direction, it will contact, at least, the surface of the ledge and the surface of the guard at a point above the center of gravity of the card which would prevent its tumbling out of the slot.

Of course, with multiple cards derived in the slot of the device of the present invention, support will be found from adjacent cards to any particular card within the slot.

Fastening means may also be used to hold the backing member, and thus the holding device, to a support such as a wall, frame, article of furniture, and the like. The fastening means may take the form of a fastener which lies flush with the first surface of the backing member so as not to interfere with holding of any of the cards within the slot found in the device of the present invention.

It should be noted that a novel and useful device for holding a single card or multiple cards, such as key cards has been hereinabove described.

It is therefore an object of the present invention to provide a device for holding a single card or multiple cards which may be easily mounted on any particular surface that is preferable found near a door when the cards involved are key cards.

Another object of the present invention is to provide a holding device for a key card which is capable of supporting a single key card or multiple key cards in an accessible configuration without the possibility of a single card inadvertently escaping from the device of the present invention.

A further object of the present invention is to provide a holding device for a single card or multiple cards which is not bulky and may be employed in many environments.

A further object of the present invention is to provide a holding device for a single card or multiple cards which is easy to manufacture and repair.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments which should be taken in conjunction with the hereinabove described drawings.

Figure 1:
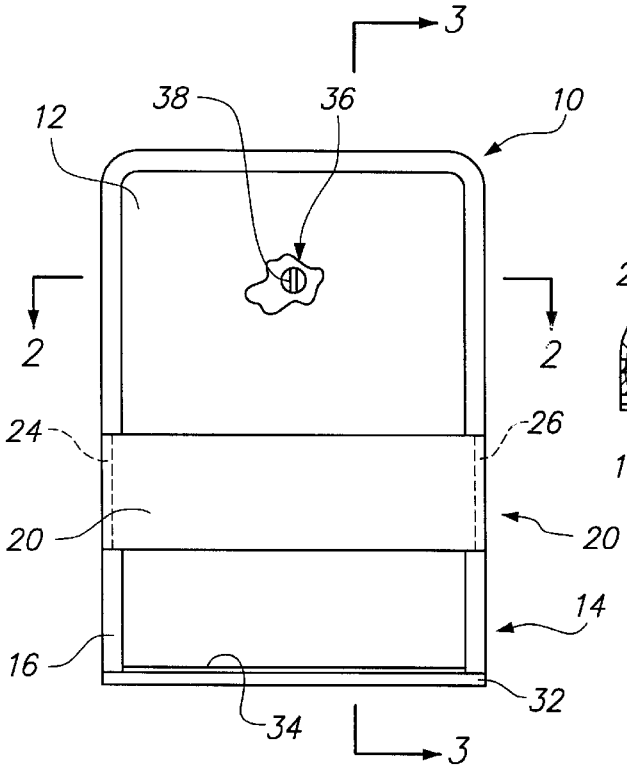
FIG. 1 is a front elevational view of the device of the present invention.
Figure 2:
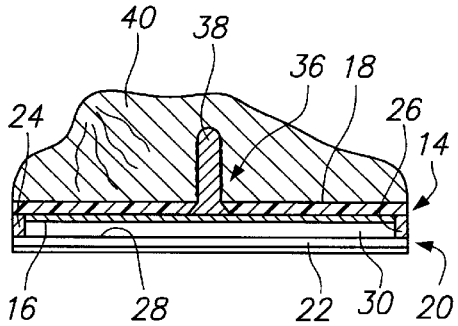
FIG. 2 is a sectional view taken along line 2—2 of FIG. 1.

The invention as a whole is shown in the drawings by reference character 10. Device 10 is intended to hold a single card or multiple cards such as those used as key cards. For example, FIG. 1 shows a single card 12 used with device 10 of the present invention. With reference to FIGS. 1 and 2, it may be observed that device 10 includes as one of its elements a backing member 14. Backing member 14 is essentially rectangular solid and includes a first surface 16 and a second opposite surface 18. Card 12 is shown adjacent first surface 16 of backing member 14. Backing member 14 may be constructed of any suitable material such as metal, wood, glass, and the like. In the drawings, backing member is shown as being constructed of plastic material which is preferably molded. Surface 16 of backing member 14 may be hardened to resist abrasion.

Guard 20 is also included in device 10. Guard 20 is formed with a spanning member 22 which extends across backing member 14. Flanges 24 and 26 connect to spanning member 22 and to backing member 14. Spanning member 22 includes a surface 28 which is spaced from surface 16 of backing member 14. This relationship creates a slot 30 between backing member 14 and spanning member 22 of guard 20.

A ledge 32 is also found in device 10. Ledge 32 includes a surface 34 which extends from surface 16 of backing member 14. Surface 34 of ledge 32 extends outwardly from surface 16 a greater distance than surface 28 of spanning member 22 of guard 20. The importance of this relationship will be discussed hereinafter.

Referring now to FIGS. 1 and 2, again, it may be observed that fastening means 36 is shown. Fastening means 36 may take the form of a fastener 38 such as a screw, rivet, and the like. As depicted in FIGS. 1 and 2, fastener 38 is a flat head screw which either has been installed flush with surface 16 of backing member 14 or has been recessed relative to surface 16 of backing member 14. Fastener 38 has been placed in support 40, FIG. 2, which may be a wall, panel, article of furniture, and the like. Of course, fastener 38 would be of the type necessary to hold device 10 relative to support 40. As shown in FIG. 2, fastener 38 takes the form of a wood screw and support 40 is depicted as a wooden member.

Figure 3:
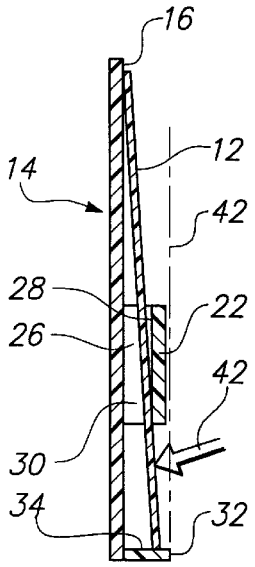
FIG. 3 is a sectional view taken along line 3—3 of FIG. 1.
Figure 4:
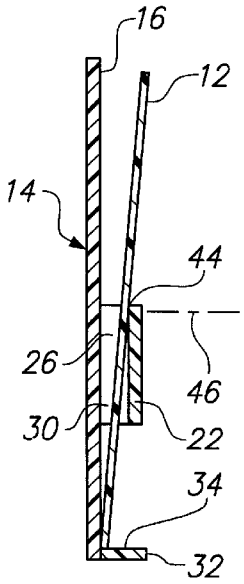
FIG. 4 is a sectional view similar to FIG. 3 except that the card being held within the slot of the device of the present invention lies in opposite orientation to that of FIG. 3.
Figure 5:
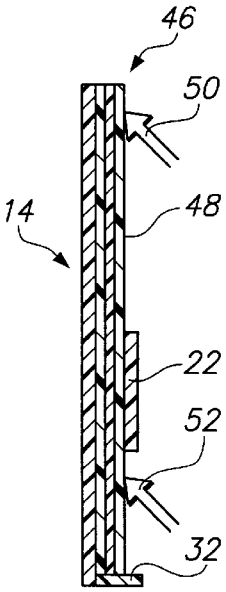
FIG. 5 is a sectional view of the device of the present invention in which multiple cards have been placed within the slot formed therewithin.

In operation, the user mounts device 10 to a support 40 using fastening means 36, externalizing in fastener 38. A single card 12 may be placed within slot 26 of device 10 as shown in FIG. 3. In such configuration, card 12 contacts surface 34 of ledge 32, and the lower portion of surface 28 of guard 22. In addition, card 12 would rest against the upper portion of first surface 16 of backing member 14. In such configuration, card 12 will not slip from slot 26, inadvertently, since ledge surface 34 extends outwardly to axis 42, which lies beyond surface 28 of spanning member 22. In addition, the user is able to retrieve the card 12 by exerting a force on card 12, directional arrow 42 which would tip card 12 backwardly and able the user to easily grasp the top portion of card 12. Turning to FIG. 4, it may be seen that if card 12 tilts in the opposite direction of that shown in FIG. 3, card 12 will contact surface 34 of ledge 32, and surface 28 of spanning member 22. Card 22 may also contact the lower portion of surface 16 of backing member 14. The upper portion, noted by contact place 44 between card 12 and surface 28, of spanning member 22 lies above the center of gravity of card 12 denoted by axis 46. Thus, card 12 will not tumble or tilt from slot 26 in this configuration. Of course, retrieval is easily accomplished without pushing on the lower portion of card 12. Referring to FIG. 5, it may be observed that multiplicity of cards 46 have been placed within slot 26 of device 10. Any of the multiplicity of cards may be easily retrieved. However, card 48, which lies the closest to spanning member 22, is most easily retrieved by simply pushing upwardly on card 48 according to directional arrows 50 or 52. It has been found that device 10 is most conveniently mounted next to a door in a hotel room where card 12 or any of the multiplicity of cards 46 are key cards.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A holding device for a single card or multiple cards, comprising:

a. a backing member, said backing member including a first surface and an opposite second surface;

b. a guard extending across and spaced from said first surface of said backing member, said guard including a surface facing said first surface of said backing member; said guard forming an unencumbered slot relative to said first surface of said backing member; and c. a ledge spaced from said guard and extending from said backing member, said ledge having a surface, said ledge surface projecting from said first surface of said backing member a distance greater than the position of said guard relative to said first surface of said backing member, at least one card extending into said slot, the card being supported to extend above said guard solely by contacting said surface of said ledge and said surface of said guard, under gravitational influence.

2. The device of claim 1 in which said surface of said guard positions from said ledge to contact the one card above the center of gravity of the card.

3. The device of claim 1 in which the area of said first surface of said backing member is larger than the area of one side of the one card.

4. The device of claim 1 which further comprises fastening means for holding said backing member second side to a support.

5. The device of claim 4 in which said surface of said guard extends from said ledge to contact the one card above the center of gravity of the card.

6. The device of claim 5 in which the area of said first surface of said backing member is larger than the area of one side of the one card.

7. The device of claim 6 in which said fastening means comprises a fastener lying at least flush with the first surface of said backing member.

* * * * *